US005769003A

United States Patent [19]

Rose et al.

[11] Patent Number: 5,769,003

[45] Date of Patent: Jun. 23, 1998

[54] KEG PALLET

[75] Inventors: Henry H. Rose; Leonard Bryan Yarnell; Daniel E. Major, all of Knoxville, Tenn.

[73] Assignee: Formall, Inc., Knoxville, Tenn.

[21] Appl. No.: 707,608

[22] Filed: Sep. 5, 1996

[51] Int. Cl.[6] ..... B65D 19/06

[52] U.S. Cl. ..... 108/55.3; 108/53.1; 108/53.3; 108/51.1; 108/901

[58] Field of Search ..... 108/55.3, 53.5, 108/901, 53.1, 51.1, 902, 53.3

[56] References Cited

U.S. PATENT DOCUMENTS

| | | | |
|---|---|---|---|
| 3,524,415 | 8/1970 | Heiman . | |
| 3,526,195 | 9/1970 | Maryonovick . | |
| 3,563,184 | 2/1971 | Angelbeck, Jr. . | |
| 3,636,888 | 1/1972 | Angelbeck, Jr. . | |
| 3,702,100 | 11/1972 | Wharton | 108/902 X |
| 3,835,792 | 9/1974 | Wharton | 108/902 X |
| 3,944,070 | 3/1976 | Cardwell et al. | 108/53.1 X |
| 3,948,190 | 4/1976 | Cook, III et al. . | |
| 3,993,168 | 11/1976 | Kubick | 108/53.1 |
| 3,995,749 | 12/1976 | Haskins | 108/53.1 X |
| 4,428,306 | 1/1984 | Dresen et al. . | |
| 4,480,748 | 11/1984 | Wind | 108/55.3 X |
| 4,516,677 | 5/1985 | Rowland et al. . | |
| 5,606,921 | 3/1997 | Elder et al. | 108/53.1 X |

FOREIGN PATENT DOCUMENTS

| | | | |
|---|---|---|---|
| 0368595 | 5/1990 | European Pat. Off. | 108/55.3 |
| 000597572 | 5/1994 | European Pat. Off. | 108/53.3 |
| 2013615 | 8/1979 | United Kingdom | 108/55.3 |
| 8806854 | 9/1988 | WIPO | 108/55.3 |

*Primary Examiner*—Peter M. Cuomo
*Assistant Examiner*—Hanh V. Tran
*Attorney, Agent, or Firm*—Luedeka, Neely & Graham

[57] ABSTRACT

A twin sheet, thermoformed beer keg pallet has a load platform reinforced by parallel ribs formed inwardly from the bottom sheet. Rib ridges are thermally fused to the platform top sheet. Stiffener pockets in the shape of truncated pyramids are formed from the top sheet between the rib ridges. Pocket bottoms are fused to the bottom sheet. Pocket sidewalls are thermally fused to adjacent rib side walls. The platform ribs have a progressively greater depth between the platform top sheet and bottom sheet along the rib length from the pallet center plane outwardly in opposite directions. When loaded and lifted by a fork truck, the platform flexes about an axis in the center plane to tilt the tops of the kegs on the pallet inwardly to the center.

22 Claims, 9 Drawing Sheets

KEG PALLET

BACKGROUND OF THE INVENTION

The present invention relates to industrial shipping pallets. More particularly, the invention relates to a pallet for unitizing keg contained liquids such as beer or liquid-like material such as powdered solids.

In the past, industrial shipping platforms have been produced from a myriad of materials but predominantly of wood. In many one-way transport utilities of low cost product, wood remains a competitive shipping platform material. However, in those circumstances involving a well organized shipping cycle of fragile, high value goods on specially constructed platforms or in specialized containers which are returned to the shipper for reuse, high density polymers and reinforced composites are emerging as a material of choice.

Although high density polymers are not new "man-made" structural materials, structural designs with such materials continue to evolve. Relative advantages and disadvantages for specific applications are defined and redefined. Among such evolving designs is the "twin sheet" pallet wherein two substantially planar load-bearing plastic sheets are secured in parallel alignment with each other by interconnected reinforcing webs and stiffening members. The legs of a twin sheet pallet project below the bottom sheet but include a tie to the top sheet. The stress distribution of a twin-sheet pallet broadly follows the model of an H-beam.

One criterion for producing a twin-sheet molded thermoplastic pallet is that of rapid cooling after the twin sheets are fused together. The molding equipment is inaccessible to further production until a previously fused product has sufficiently cooled to permit removal from the mold. Hence, the cooling rate of a product is directly related to the production rate and, hence, the production cost. Moreover, the cooling rate of a product is also strongly related to the product design. In particular, the internal configuration of webs and stiffeners between the two platforms influences the cooling rate.

A generally desirable design criterion for any shipping platform is one that interactively functions with the load on it to either secure or stabilize the load. Although beer kegs on a pallet may be strapped together at the top to stabilize the kegs from tipping when moved, such strapping imposes an additional labor burden on the product. Furthermore, strapping failures may produce an unacceptable workplace hazard.

It is an object of the present invention, therefore, to construct a pallet formed of moldable thermoplastic material that cooperates dynamically with a fluid keg load.

Another object of the present invention is construction of a twin sheet, thermoplastic material pallet that deflects under a keg load to inherently stabilize the load.

Still another object of the invention is a twin sheet molded thermoplastic pallet having an upper platform surface that, when lifted by the tines of a lift truck, deflects to a concave or cupped surface profile to better stabilize the pallet load.

A further object of the invention is a twin sheet, molded thermoplastic material pallet that is particularly suitable for carriage of beer kegs.

A still further object of the invention is a twin-sheet, molded thermoplastic material pallet having a substantially open interior volume.

Another object of the invention is a twin-sheet, molded thermoplastic material having a rapidly cooled design.

SUMMARY OF THE INVENTION

These and other objects of the invention as are apparent from the following description of the preferred embodiment, are provided by a thermoformed twin sheet pallet that is particularly suitable for liquid filled kegs such as beer kegs. The thermoformed pallet of the present invention is formed by vacuum molding a pair of thermoplastic sheets respective to the top and bottom structural features of the pallet.

Top and bottom sheets respective to the top and bottom panels of a pallet are generally separated and parallel. Foot columns projecting downwardly from the bottom panel hold the planar portions of the bottom panel above the floor support surface for access by lift truck tines. A preferred embodiment of the invention provides for three rows of foot columns aligned with a central row symmetrically flanked by two parallel lateral rows. The general plane of the top panel is substantially perpendicular to a center plane through the central row foot column. The general plane of the bottom panel, however, diverges from parallelism with the top panel at a shallow angle of up to about 2° substantially symmetrically from the center plane.

Spanning the separation distance between the top and bottom panels are a multiplicity of parallel ribs having converging walls projected inwardly from the pallet bottom panel into thermal fusion with the top panel along respective rib ridges. These ribs are in two parallel rows between the center plane and the respective lateral or flanking planes. The depth of these ribs corresponds with the general divergence angle of the bottom panel from parallelism with the top panel. As a consequence of the progressive increase in rib depth outwardly from the pallet center plane, the pallet platform tends to bend about an axis within the center plane. This bending causes the barrels on the top platform to tilt inwardly into mutual top end contact for a more stable ride position during lift truck transport.

Along the center plane respective to the two parallel rows of ribs, stiffening pockets are projected inwardly from the top panel between alternate ribs into thermal fusion between the pocket bottom with the bottom panel. The pockets are formed in a truncated pyramid shape having converging side panels. An opposite pair of respective side panels are thermally fused with adjacently converging rib walls.

Such stiffener pockets are placed between alternating ribs respective to opposite sides of the central foot support plane to preserve an open gas passage way between opposite sides of the pallet and between the top and bottom panels.

From the general plane of the first embodiment top panel, fences are projected upward or outward from the top panel to laterally confine the keg bases and prevent any lateral sliding of a keg base relative to the pallet top panel. The pallet fences are also provided with a footing surface to receive the bottoms of vertically aligned foot columns respective to an identical pallet vertically stacked upon a lower pallet.

The foot columns along the center plane comprise a stubby leg adjacent the pallet outer perimeter and a central support pedestal. The lateral plane foot columns comprise the pallet corner legs with a support pedestal between each pair of corner legs. A vertically stacked pair of pallets present a substantially continuous outer wall along the two lateral foot support planes and restrict lifting tine access under those pallets stacked upon pallets from those two directions. Lifting tine access space is provided under the lowermost pallet resting on a substantially flat surface or floor. Considerably greater lifting tine access is provided at all levels of a pallet stack to approaches from the other two directions.

A second preferred embodiment of the invention provides a substantially cylindrical projection up a few inches from the pallet top sheet base. The projection cylinder diameter is coordinated to a circular socket in the pallet loaded article, e.g. the footer and header rings that stabilize the oval keg shape. Preferably, the projection has a fluted perimeter and a sloped riser face. The keg is positioned over the projection whereby the projection penetrates the keg foot ring and restricts lateral sliding of the keg. Because of the sloped riser face between the projection base and projection end face, the kegs may be swept off the pallet by a laterally swinging boom thereby mechanically separating empty kegs from pallets when desired.

Another feature of the invention appears in the pallet support column where the top and bottom sheets are fused together for maximum wall thickness. Selectively positioned internal head cavities in the upper sheet mold form provide a yield space for excess material and prevents air encapsulation between the two sheets. Additionally, internal leg beads aligned up the length of a pallet support column nest against a planar outside surface to prevent a nested assembly of pallets from adhering together by a vacuum induce pressure differential between the nested columns.

BRIEF DESCRIPTION OF THE DRAWINGS

Regarding the drawings wherein like reference characters designate like or similar elements throughout the several figures of the drawings.

DESCRIPTION OF THE PREFERRED EMBODIMENTS

Pallets of the present invention are generally fabricated from two sheets of thermoplastic material using a vacuum thermoforming process. High density polyethylene of 0.95 g/cc density or greater is the most frequent material of choice but other suitable materials include polyvinyl chloride, polystyrene, polystyrene-bentadiene copolymers, polyvinyl halide polymers and methacrylate copolymers. Depending on the pallet service intended, such thermoplastic sheets may begin processing with a substantially uniform sheet thickness of a few thousands of an inch to a quarter of an inch or greater.

As the fabrication process proceeds, each of two thermoplastic sheets are positioned in respective, thermoform vacuum molds. Each mold is one sided in that the heated, structurally viscous sheet is pressed by atmospheric pressure against a form when the atmosphere between the form and the sheet is evacuated. The sheet is cooled against the form to retain the form configuration and ejected from the mold.

One sheet is molded to the top surface configuration and the other sheet is molded to the bottom surface configuration. The respective top and bottom molds are thereafter brought together and thermally fused around the pallet perimeter and at selected internal joints. The unitized product is thereafter sufficiently cooled to secure the integrity of the molded shape and ejected from the mold as a substantially finished product. Some designs may require fitting installations, aperture cutting or other specialized forming not reasonably possible prior to mold removal.

Twin sheet pallet production rate is highly influenced by the product cooling rate. Since the mold cannot be freed of a completed product until cool enough to retain its shape, fabrication of a successive product is delayed during the requisite heat transfer interval. The spacial void between the two sheets is filled with hot air.

To reduce the pallet cooling interval, apertures are formed in the pallet wall structure to inject cool air within the internal labyrinth of the pallet and withdraw the hot air. For each isolated volume within the pallet interior, at least two apertures and an air delivery system are required. For this reason, pallet designs having a substantially open internal volume are preferred.

Figure 1:
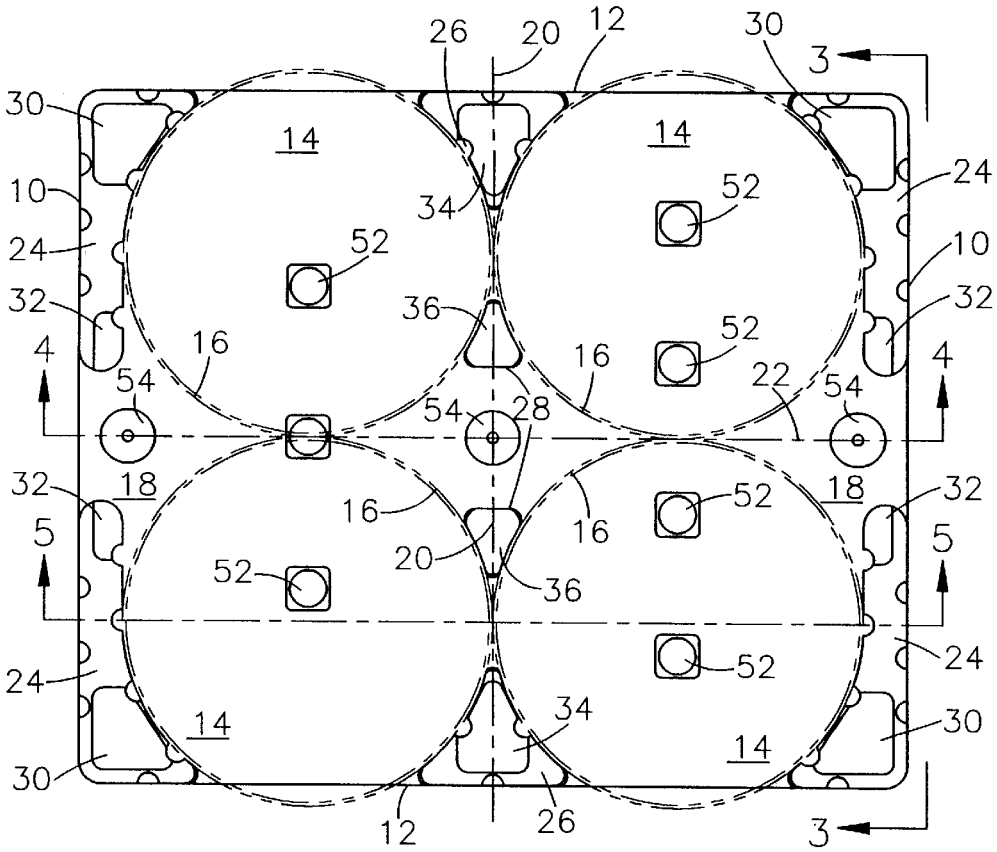
FIG. 1 is a top plan view of a first embodiment of the invention.
Figure 4:
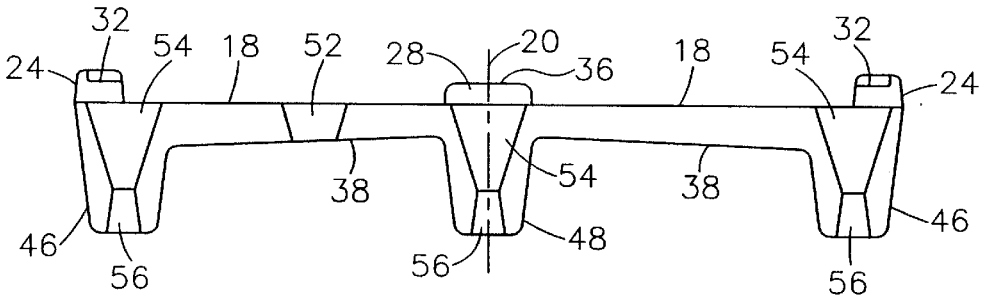
FIG. 4 is a sectioned elevation view of the invention first embodiment along cutting plane 4—4 of FIG. 1.
Figure 5:
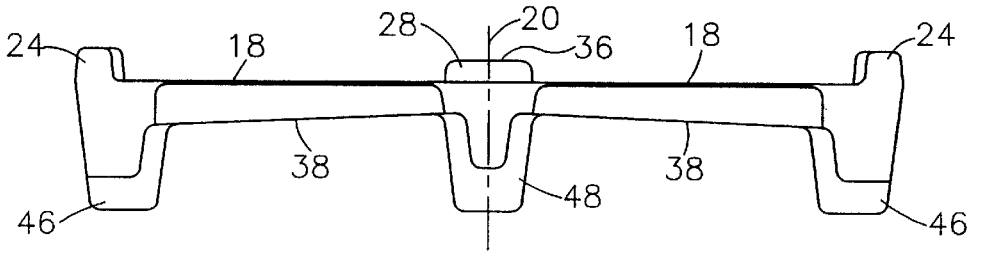
FIG. 5 is a sectioned elevation view of the invention along cutting plane 5—5 of FIG. 1.

With respect to the top plan of FIG. 1, the invention comprises a substantially rectangular pallet wherein the length of pallet sides 10 are less than that of the sides 12. Pallet layout is substantially symmetrical about the transverse center planes 20 and 22. For descriptive convenience, however, the short center plane 20 will be the center plane of reference unless specifically noted otherwise hereafter.

Formed upwardly from the generally planar top platform 18 of the pallet are a multiplicity of fences which externally confine the circular base perimeters 16 of four beer kegs 14 in a closely assembled cluster. Corner fences 24 extend around respective corners to restrain a keg from sliding off the pallet over either the long or short pallet side. Interior fences 26 and 28 further restrict sliding latitude of the kegs 14.

Each of the corner fences 24 are provided with a stacking support surfaces 30 and 32 that are notched below the upper edge of the fence body. Interior fences 26 and 28 are topped by respective stacking surfaces 34 and 36. All of the stacking surfaces 30, 32, 34 and 36 are aligned in the same intermediate plane above the top platform 18 but below the upper edge of the corner fences 24. Additionally, these stacking surfaces are vertically aligned with select portions of the pallet legs and pedestals as will be further described hereafter.

Figure 2:
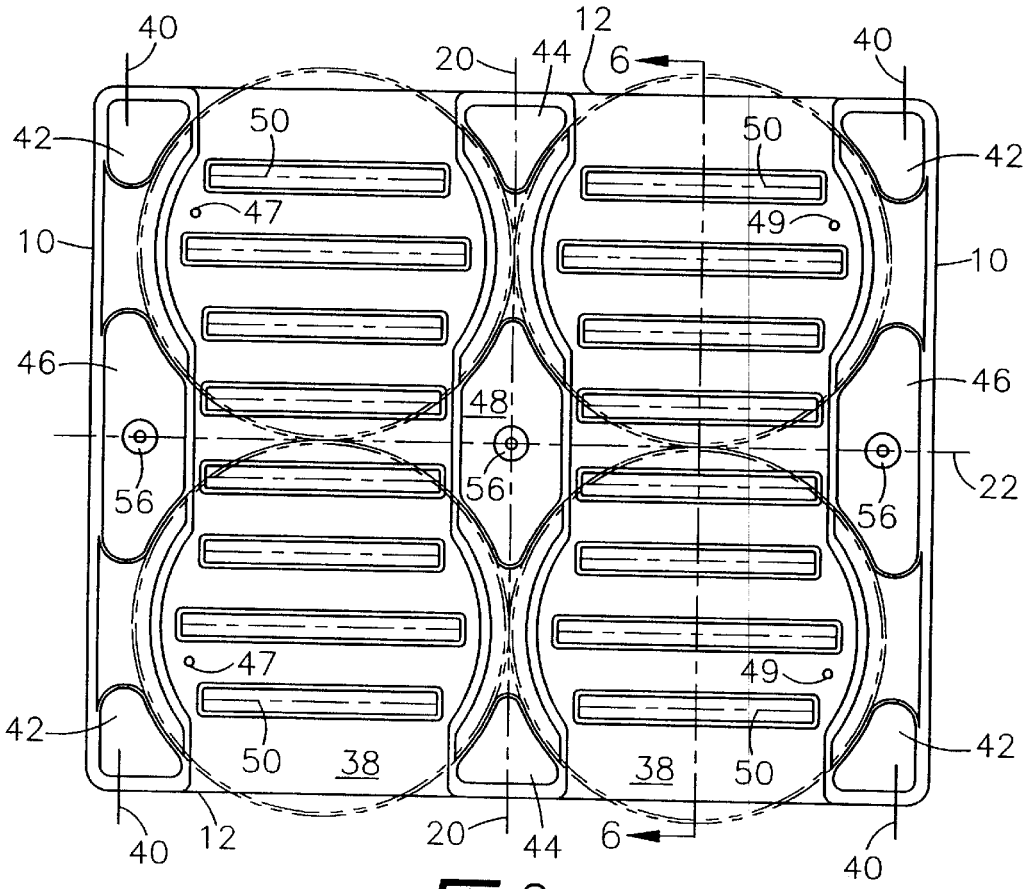
FIG. 2 is a bottom plan view of the invention first embodiment.
Figure 3:
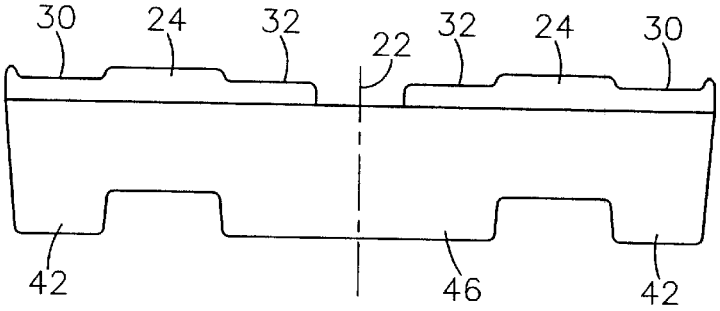
FIG. 3 is a side elevation view of the invention first embodiment along the 3—3 viewing plane of FIG. 1.
Figure 6:
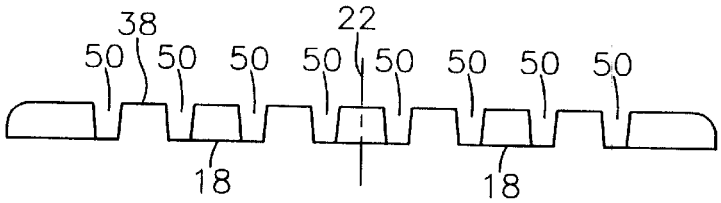
FIG. 6 is an unconventional sectioned elevation of the invention first embodiment viewed along cutting plane 6—6 of FIG. 2.

Referring to the pallet bottom plan of FIG. 2, three rows of platform support pedestals are molded to project down from the general plane of the bottom platform 38. These rows are aligned along the center plane 20 and two laterally flanking planes 40. Respective to each long side of the pallet 12, the support pedestals comprise the corner pedestals 42 and the center leg 44. Between each pair of corner pedestals 42 along the pallet short side 10 is a midlength pedestal 46. Between the pair of long side center legs 44 is an elongated central pedestal 48. All of the support pedestals have bottom surfaces in a common plane that is substantially parallel with the top platform plane 18.

As viewed at FIG. 2 between the center plane 20 and the two flanking planes 40 are two rows of substantially parallel ribs 50. Preferably, the ribs 50 are formed with sidewalls that diverge from a bottom ridge to a top image that is thermally fused to the underside of the top platform 18.

Between alternate pairs of ribs 50 respective to alternating rows, pockets 52 in the configuration of a truncated pyramid are formed from the top platform 18 to thermally fuse with the rib 50 sidewalls and the topside of the bottom platform 38. These pockets 52 contribute greatly to the rigidity and stiffness of the pallet unit by opposing rib 50 wall buckling.

Along the long center plane 22, conical pockets 54 are formed inwardly from the top platform 18 to meet and fuse with conical pockets 56 formed from the bottom face of support pedestals 46 and 48. A fused meeting between the pockets 54 and 56 provides a tie between the top platform and the lowermost support pedestals thereby further rigidifying the pallet unit.

Apertures 47 in the pallet bottom are punched by air supply needles when the two preformed, hot polymer sheets are combined. Through the apertures 47 fresh cold air is released from high pressure sources into the internal labyrinth between the top and bottom platform sheets. If an atmospheric gas pumping or vacuum system is available, exhaust needle 49 may be connected to such a high volume vacuum system to accelerate removal of the hot, internal air simultaneous with entry of cold air from the apertures 47.

Figure 7:
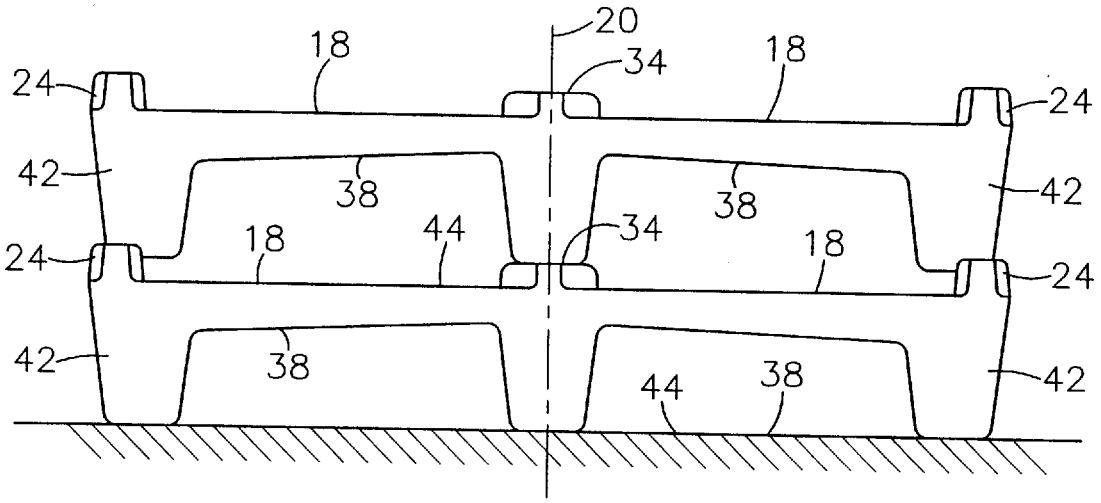
FIG. 7 is a stacked assembly of first embodiment pallets as viewed along a front or rear approach direction.

Continuing with the previously described vertical alignment between the stacking surfaces 30, 32, 34 and 36 on the top platform fences and the bottom surfaces of the support pedestals, FIG. 7 illustrates this alignment by an elevational view of vertically stacked pallets into the long side of the pallets. Such stacking represents a return and recycling step wherein a plurality of empty pallets are assembled and stacked for efficient return transport.

Figure 8:
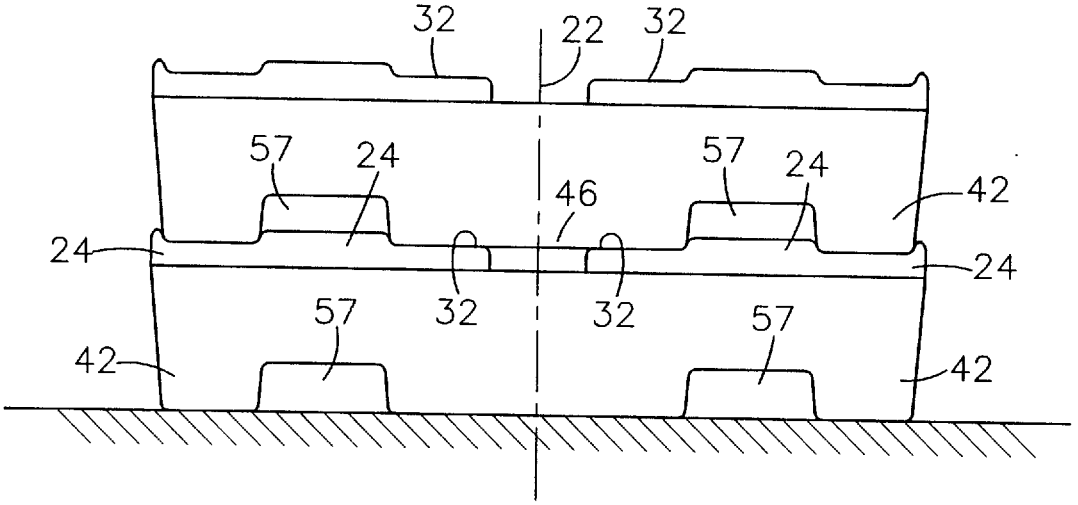
FIG. 8 is a stacked assembly of first embodiment pallets as viewed along either side approach directions.

The corner pedestals 42 socket into the stacking surface notch 30 while the long side center leg 44 simultaneously engages the face of stacking surfaces 36. FIG. 8 illustrates the same relationship with an elevational view into the short side of a pair of stacked pallets. Here, it is seen that the midlength pedestal 46 bridges between the inside corner fence stacking surfaces 32 respective to two aligned corner fences 24.

Also to be noted from FIG. 8 is the substantially continuous sidewalls linking the support pedestals respective to alignment planes 20 and 40. Such wall depth contributes greatly to the unit rigidity about a flexure axis along the longitudinal center plane 22. Notwithstanding a substantially continuous box wall along and between the corner pedestals 42, notched spaces 57 provide a limited but highly desirable tine space for penetration by the slender lifting tines of industrial lift trucks.

Figure 9:
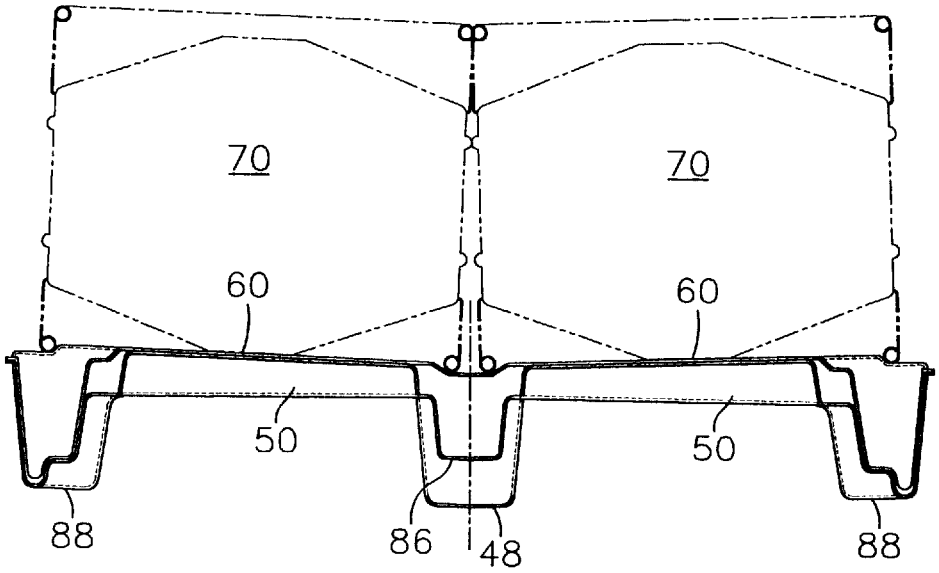
FIG. 9 is an exaggerated elevational view illustrating the stabilizing cup of the pallet when lifted under load by the tines of a lift truck.

FIG. 7 also vividly illustrates the divergent angular relationship of the bottom platform 38 relative to the plane of top platform 18. Generally, top platform 18 is substantially normal to the center plane 20. The general plane of the bottom platform 38 diverges from the general plane of the top platform 18 at a small angle of up to about 6° as the bottom platform advances from the center plane 20 accordingly, the separation space between the top and bottom ridges of the ribs 50 increases progressively from the center plane 20 toward the laterally flanking planes 40. By this configuration, the pallet support surface is most stiff along the flanking leg pairs. Conversely, when lifted under the load of four beer kegs, the pallet platform bows about a rotational axis near the center plane 20 and above the top platform surface. Although the bowing is slight, it is nevertheless sufficient to tilt the kegs inwardly into mutual contact at or near the keg upper rims as exaggeratedly illustrated by FIG. 9. Such tilting is not only a favorable shift in the load center of gravity but also provides a frictional resistance to further movement at the most highly leveraged location on the load unit.

The invention embodiment of FIGS. 10 through 16 includes numerous features common to the FIG. 1 through 8 embodiment such as the tapered depth ribs 50 and three rows of platform support pedestals. There are differences also. One such difference is embodied in structure to restrain kegs from sliding off the top platform surface in transport. In the FIG. 1 through FIG. 8 embodiment, that structure is the fence means 24, 26 and 28. Although a perimeter fence structure functions well for the primary purpose of position restraint, a fence structure does not adapt well to any material handling process in which kegs, whether empty, partially full or full are separated en masse from their support pallet by a turnstile or rotating boom mechanism. Rotation of the boom sweeps the kegs onto an adjacent conveyor belt while the pallet continues in a different direction along a different conveyance channel.

Figure 11:
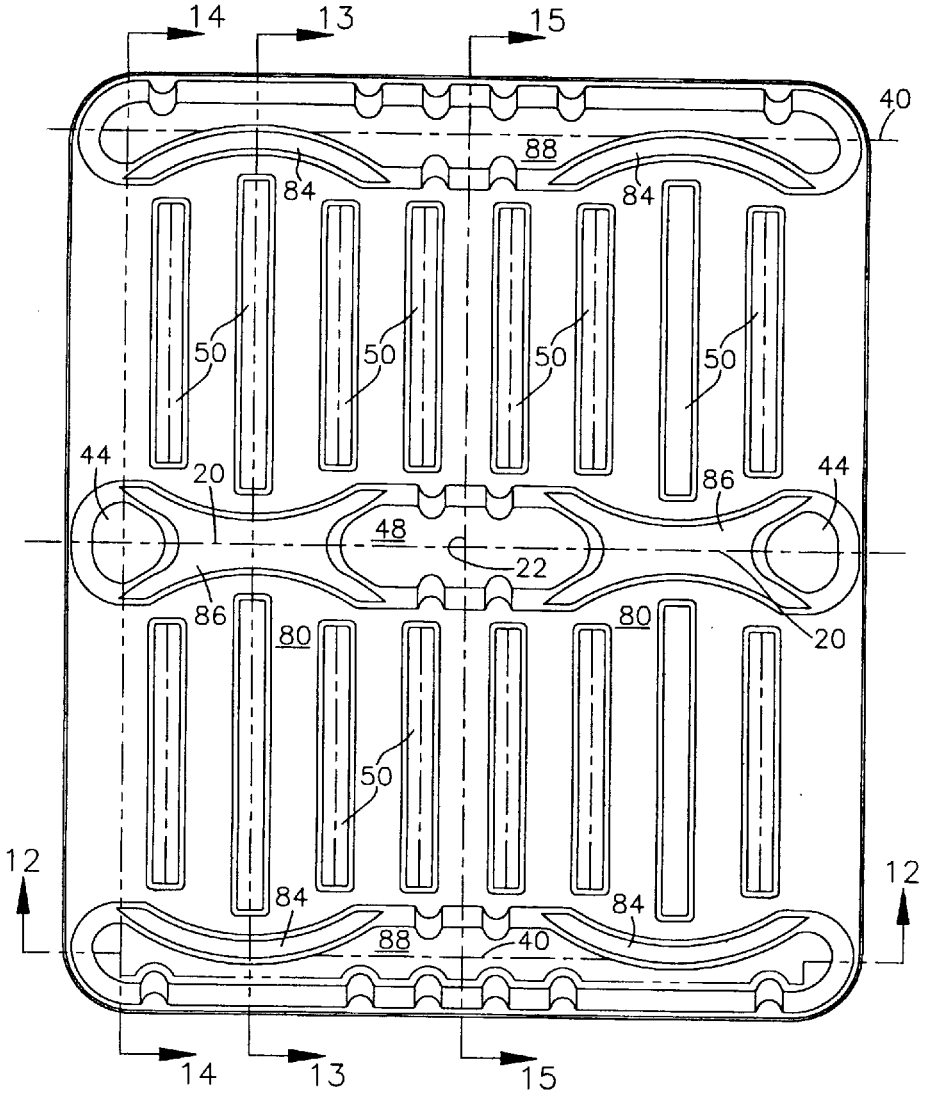
FIG. 11 is a bottom plan view of the invention second embodiment.
Figure 16:
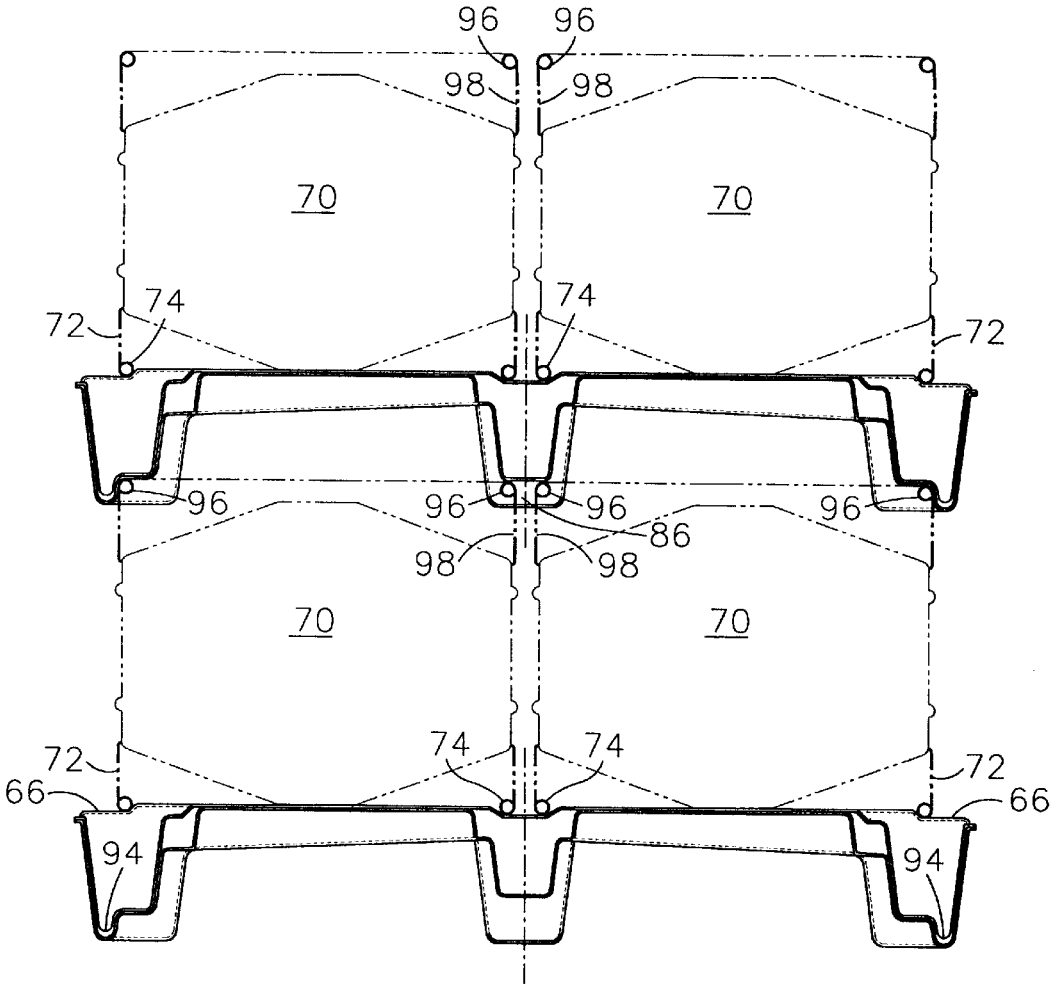
FIG. 16 is a sectioned elevation of a stacked assembly of second embodiment pallets viewed along the cutting plane 13—13 of FIGS. 10 and 11.
Figure 12:
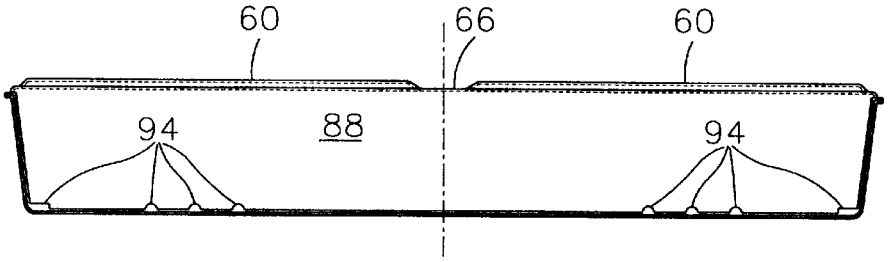
FIG. 12 is a sectioned elevation view of the invention second embodiment along cutting plane 12—12 of FIGS. 10 and 11.
Figure 13:
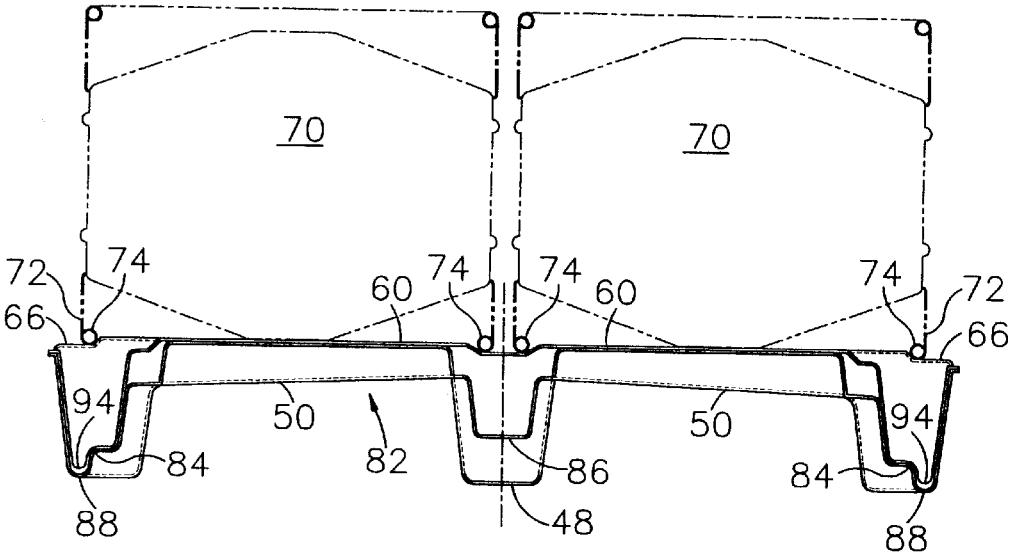
FIG. 13 is a sectioned elevation view of the invention second embodiment along cutting plane 13—13 of FIGS. 10 and 11.
Figure 14:
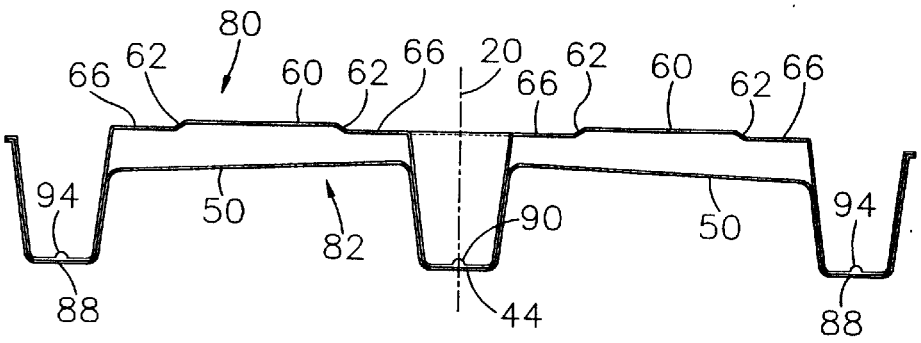
FIG. 14 is a sectioned elevation view of the invention second embodiment along cutting plane 14—14 of FIGS. 10 and 11.
Figure 15:
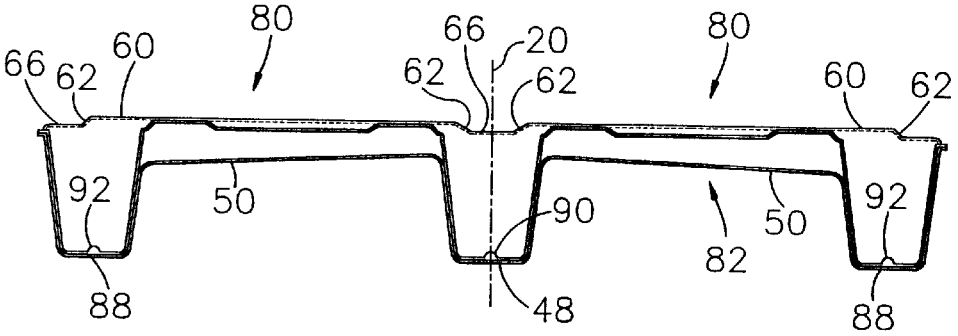
FIG. 15 is a seconded elevation view of the invention second embodiment along cutting plane 15—15 of FIGS. 10 and 11.

In accommodation of such rotating boom machinery for removing kegs, the FIG. 10 through FIG. 16 embodiment of this invention relies upon a cylindrical protrusion 60 having a sloped riser face 62 around a scalloped or fluted perimeter. The scallop points 64 of the protrusion 60 are aligned in a circle to nest within the footer tube 74 of a keg 70 support cylinder 72 (FIG. 13). Degrees of resistance to sliding displacement of the kegs from the pallet may be regulated by the height of the protrusion 60 above the lower support surface 66 of the top platform 80 and by the riser face 62 slope angle.

With respect to the bottom profile of a FIG. 11 embodiment, the support pedestals 88 are configured with inside ledges 84 and center island surface 86 to receive the upper support tube 96 respective to a keg 70 upper cylinder support 98.

Another distinctive feature of the FIG. 10 through FIG. 16 embodiment of the invention are the bead profiles characterized on the drawing as elements 90, 92 and 94. Beads 90 are aligned with the center plane 20 along the interior bottom of center legs 44 and central pedestal 48. Beads 92 arc along the interior bottom of lateral skid supports 88 and beads 94 are formed in the extremities of the lateral skids 88. To be particularly noted from these skids 88 as shown by FIG. 12 is the absence of a lift truck tine space as provided in the lateral platforms 46 of the FIG. 1 embodiment. Consequently, this FIG. 10 design configuration permits lift truck access from only two of four directions.

Figure 10:
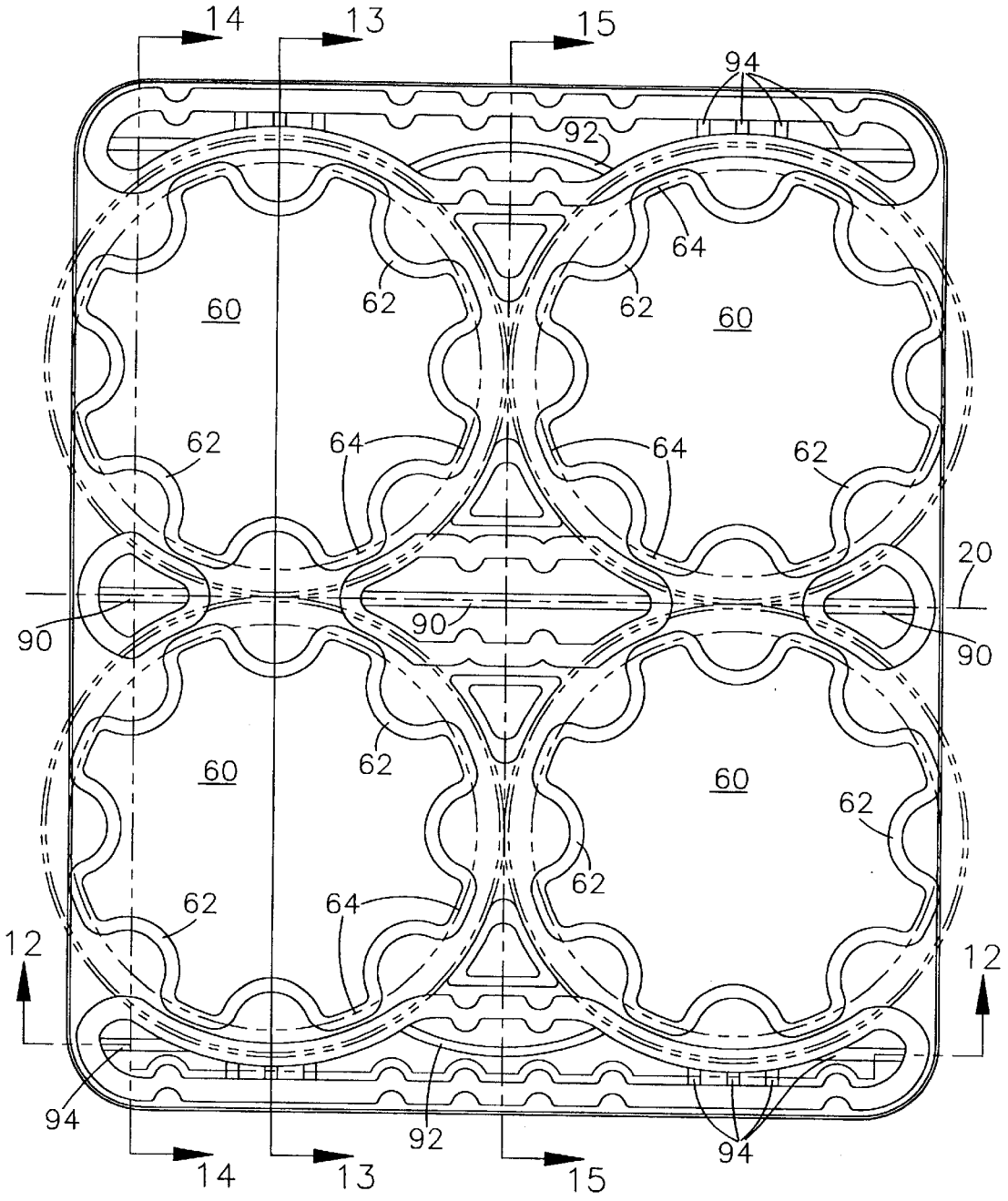
FIG. 10 is a top plan view of a second embodiment of the invention.

Also to be noted from the FIG. 10 embodiment is that the beads 90, 92 and 94 are not profiled in the platform bottom sheet 82. These beads are considered as excess material volumes for the top sheet 80 but have the surprising consequence of substantially eliminating air bubble voids at the fusing interface between the upper and lower sheets 80 and 82.

To achieve maximum leg or support platform strength and rigidity, fusion between the upper and lower platform sheets 80 and 84 is desired around the entire leg or pedestal perimeter below the bottom platform. When the two sheets are brought together for fusion, however, defects often arise due to air trapped between the top and bottom sheets 80 and 82. Although the mechanics are unclear, it has been found that excess material beads 92, 94 and 96 tend to eliminate the problem of poor fusion and air pockets.

As previously noted, the bead profile is formed only as an unevacuated channel in the upper platform molding surface. Sheet 80 conformity to the mold channel during the vacuum forming step of the process is nominal if at all. However, when the preformed bottom sheet 82 is brought into hot, pressured contact with the fusion surfaces of the upper sheet, bond is substantially complete.

As an example, full surface fusion of pallet legs formed from two sheets of 0.180 in. nominal thickness material produces a fused leg base web of about 0.157 in. to about 0.216 in. Thickness along the crest of bead 90 on the internal pocket surfaces of the skids 88 ranges from about 0.511 in. to about 0.550 in. Beads 92 have a crest thickness of about 0.300 in. to about 0.337 in. Clearly, the thermoplastic material is redistributed about the pallet leg. It is not clear, however, how this redistribution substantially eliminates air pockets along the fusion surface interface. Nevertheless provisions of the beads 90, 92 and 94 has that desirable result. Fusion is substantially complete with very little air pocket interruption.

Figure 17:
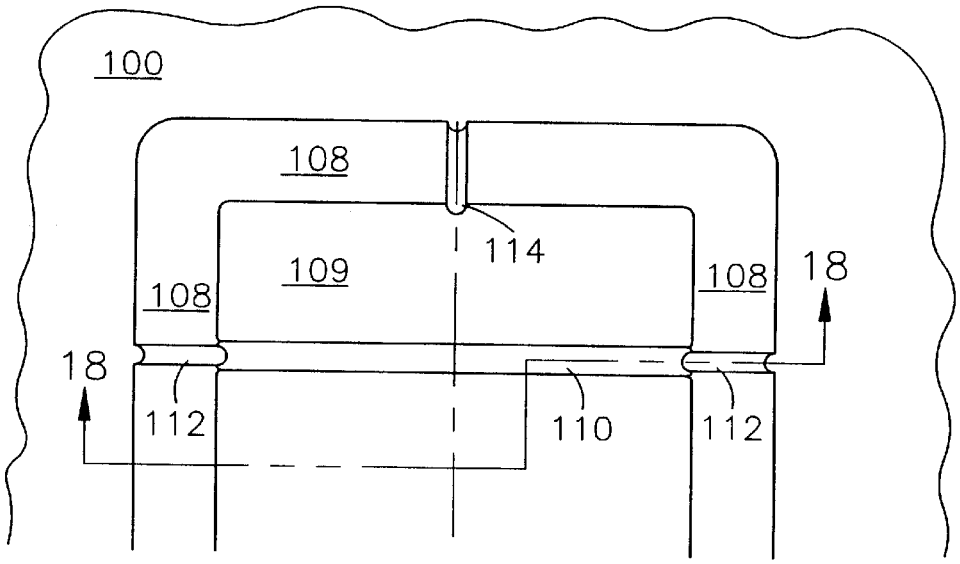
FIG. 17 is a partial top plan view of an unusual feature of the invention molded into a traditional prism leg.
Figure 18:
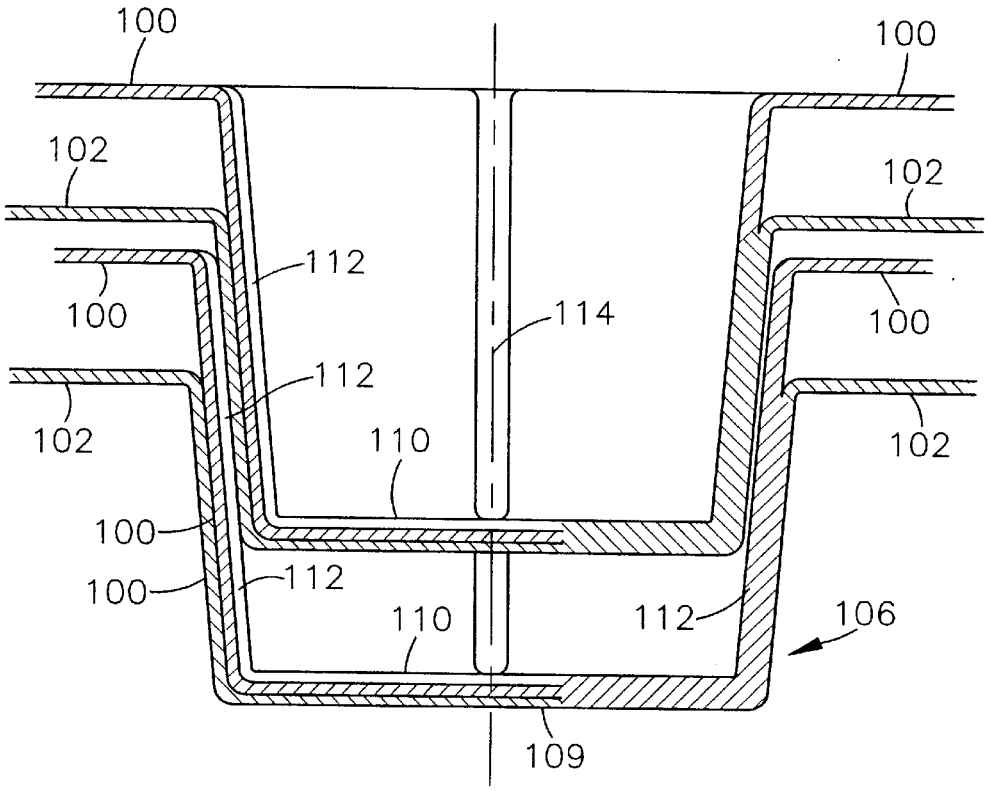
FIG. 18 is a sectioned elevation of a stacked assembly of pallet legs.

The invention embodiment of FIGS. 17 and 18 illustrate a traditional twin-sheet pallet leg with the inside bead concept of this invention integrated therewith. FIG. 17 is a plan view of the arrangement whereas FIG. 18 is a sectioned elevation taken along a pair of nested legs having inside beads along four tapered leg walls as well as across the base of the leg. Both pallets are formed from twin sheets 100 and 102. A pallet leg 106 comprises four converging shank walls 108 and a footing web leg base 109. Spanning the footing web is a transverse bead 110 protruding only into the interior volume of the leg. At opposite ends of the base bead 110 is a wall bead 112 rising from the interior footing web to the top surface of upper sheet 100. Additionally, wall beads 114 rise from the footing web 109 along the other walls of the leg.

When nested as illustrated by FIG. 18, the legs of respective pallets engage only along line contact between the crest of beads 112 and 114 against the planar exterior surface of bottom sheet 102 respective to the pallet above. There being only tapered line contact between the vertically nested legs, denesting and separation is greatly facilitated.

Having fully disclosed the preferred embodiment of our invention,

We claim:

1. A twin sheet pallet formed from a pair of thermoplastic material sheets comprising:

top and bottom platforms having a general separation space between planes respective to said platforms;

a center plane aligned substantially normal to the top platform plane;

a plurality of platform foot columns projecting from said bottom platform along said center plane and along first and second lateral planes on opposite sides of said center plane and substantially parallel therewith;

a plurality of parallel ribs formed from said bottom platform to extend longitudinally between said center plane and said lateral planes, said ribs having alternating top ridges and bottom ridges connected longitudinally by sidewalls formed inwardly from said bottom platform toward said top platform, the longitudinal extension of said ridges aligned substantially perpendicular to said center plane, said top ridges being thermally fused with said top platform, a separation space between said top ridges and bottom ridges increasing progressively from said center plane toward said lateral planes; and, a plurality of pockets formed inwardly from said top platform toward said bottom platform, said pockets having respective pocket bottoms and side walls, and pocket bottoms being thermally fused with said bottom platform and pocket side walls being thermally fused with adjacent rib sidewalls.

2. A twin sheet pallet as described by claim 1 having a plurality of fences projecting from said top platform in substantially oppositely directed alignment with said foot columns.

3. A twin sheet pallet as described by claim 2 wherein said fences include support surfaces displaced from said top platform for supporting the foot columns of a vertically contiguous pallet.

4. A twin sheet pallet as described by claim 1 having space between foot columns supported by a substantially planar surface for penetration by lifting tines from four directions around a perimeter of said pallet.

5. A twin sheet pallet as described by claim 3 having space between said foot columns engaged with support surfaces on fences respective to a vertically contiguous pallet below said foot columns for penetration by lifting tines from at least two directions around a perimeter of said pallet.

6. A twin sheet pallet as described by claim 5 wherein said foot columns and fences have outward facing perimeter surfaces whereby said outward facing surfaces combine vertically as a continuous barrier to lifting tine penetration of space between said foot columns from at least two directions around said pallet perimeter.

7. A twin sheet pallet as described by claim 1 wherein said ribs are aligned with substantially parallel ridges and uniform spacing on opposite sides of said platform center plane.

8. A twin sheet pallet as described by claim 1 wherein pockets are formed between each of said ridges but alternating with respect to opposite sides of said center plane.

9. A twin sheet pallet as described by claim 1 having a plurality of at least partial cylindrical protrusions projecting from a base corresponding with said top platform plane to an end face plane.

10. A twin sheet pallet as described by claim 9 wherein said cylindrical protrusions have fluted perimeters.

11. A twin sheet pallet as described by claim 9 wherein said cylindrical protrusions have sloped riser faces between said base and said end face.

12. A twin sheet pallet as described by claim 1 wherein portions of said top platform are formed to fit within the foot columns of said bottom platform with a substantially continuously fused surface perimeter between contiguous portions of said top and bottom platforms.

13. A twin sheet pallet formed from a pair of thermoplastic material sheets comprising:

top and bottom platform sheets having a general separation space between planes respective to said platforms;

a center reference plane aligned substantially normal to the top platform plane between and substantially parallel with a pair of lateral reference planes;

a plurality of parallel ribs formed from said bottom platform sheet to extend longitudinally between said center reference plane and said lateral reference planes, said ribs having alternating top ridges and bottom ridges connected longitudinally by side walls formed from said bottom platform sheet toward said top platform sheet, said top ridges being thermally fused with said top platform sheet, a separation space between said top ridges and bottom ridges increasing progressively from said center reference plane toward said lateral reference planes a plurality of support columns formed from said bottom platform sheet to project away from said top platform plane; and;

a plurality of substantially cylindrical protrusions projecting from said top platform plane in a direction opposite from said support columns to an end face plane, said protrusions being arranged to engage a recessed portion of a pallet carried article for restraint of said article from lateral displacement along said top platform plane.

14. A twin sheet pallet as described by claim 13 wherein said cylindrical protrusions have fluted perimeters.

15. A twin sheet pallet as described by claim 14 wherein said cylindrical protrusions have sloped riser faces along said perimeters between said top platform plane and said end face plane.

16. A twin sheet pallet as described by claim 15 wherein pockets are formed from material respective to said top platform sheet into each of said support columns.

17. A twin sheet pallet as described by claim 16 wherein each of said support columns includes a footing web for engaging a pallet support surface, a perimeter around said footing web being connected to said top and bottom platform sheets by a substantially continuous shank wall.

18. A twin sheet pallet as described by claim 17 wherein material respective to said top platform sheet within said support column pockets is integrally fused with contiguous bottom platform sheet material.

19. A twin sheet pallet as described by claim 18 wherein beads of top platform sheet material are molded within said pockets along said footing web.

20. A twin sheet pallet as described by claim 18 wherein beads of top platform sheet material are molded within said pockets along said shank wall.

21. A twin sheet pallet thermoformed from a pair of thermoplastic material sheets comprising:

a pallet platform top sheet and a generally parallel, specially separated pallet platform bottom sheet;

pallet legs drawn from portions of platform bottom sheet material, said legs having a footing area for engaging a pallet support surface and shank walls enclosing an internal leg volume between said footing area and said platform bottom sheet;

pallet leg pockets drawn from portions of pallet platform top sheet material into said internal leg volume said portions of top sheet material in said pockets being thermally joined with a substantially continuous fusion along adjacent footing area and shank wall portions of said bottom sheet material; and, a substantially continuous bead of top sheet material projecting into said internal leg volume along a line traversing said shank wall and said footing area for maintaining a separation space between internal leg volume surfaces respective to shank wall and external surfaces of a corresponding nested pallet leg.

22. A twin sheet pallet as described by claim 21 wherein additional beads of top sheet material only traverse said shank walls between said footing area and said platform top sheet.

* * * * *

UNITED STATES PATENT AND TRADEMARK OFFICE

CERTIFICATE OF CORRECTION

PATENT NO. : 5,769,003

DATED : June 23, 1997

INVENTOR(S) : Henry H. Rose; et al.

It is certified that error appears in the above-identified patent and that said Letters Patent is hereby corrected as shown below:

Column 5, line 26 change "image" to -- ridge --.

Signed and Sealed this

First Day of December, 1998

*Attest:*

Bruce Lehman

BRUCE LEHMAN

*Attesting Officer*

*Commissioner of Patents and Trademarks*